US006241239B1

(12) United States Patent
Oberhoffner et al.

(10) Patent No.: US 6,241,239 B1
(45) Date of Patent: Jun. 5, 2001

(54) DEVICE FOR OUTPUTTING SINGLE SHEETS FROM A PRINTER

(75) Inventors: Gerhard Oberhoffner, München; Armin Ulber, Lohhof, both of (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 09/284,764

(22) PCT Filed: Oct. 20, 1997

(86) PCT No.: PCT/DE97/02420

§ 371 Date: Jun. 1, 1999

§ 102(e) Date: Jun. 1, 1999

(87) PCT Pub. No.: WO98/17569

PCT Pub. Date: Apr. 30, 1998

(30) Foreign Application Priority Data

Oct. 22, 1996 (DE) ..... 196 43 625

(51) Int. Cl.[7] ..... B65H 31/00

(52) U.S. Cl. ..... 271/208

(58) Field of Search ..... 271/208

(56) References Cited

U.S. PATENT DOCUMENTS

| | | | | |
|---|---|---|---|---|
| 3,826,379 | | 7/1974 | Wright | 271/208 |
| 3,957,264 | * | 5/1976 | Bach et al. | 271/208 |
| 3,988,018 | * | 10/1976 | Tusso et al. | 271/208 |
| 4,129,295 | | 12/1978 | Hori et al. | 271/186 |
| 4,322,069 | | 3/1982 | Mitchell | 271/296 |
| 4,511,238 | | 4/1985 | Hori . | |
| 4,570,801 | | 2/1986 | Brannen . | |
| 4,951,935 | * | 8/1990 | Oikawa | 271/208 |
| 5,478,061 | * | 12/1995 | Murakami et al. | 271/208 |

FOREIGN PATENT DOCUMENTS

| | | | | |
|---|---|---|---|---|
| 2 307 401 | | 8/1973 | (DE) . | |
| 17 86 630 | | 6/1980 | (DE) . | |
| 33 41 413 | | 5/1984 | (DE) . | |
| 37 00 959 | | 8/1987 | (DE) . | |
| 36 32 100 | | 3/1988 | (DE) . | |
| 39 22 045 | | 1/1991 | (DE) . | |
| 91 08 218 | | 10/1991 | (DE) . | |
| 31 36 113 | | 5/1992 | (DE) . | |
| 2238302 | * | 5/1991 | (GB) | 271/208 |
| 4-243740 | * | 8/1992 | (JP) | 271/208 |

OTHER PUBLICATIONS

European Patent Office—Patent Abstracts of Japan—55 149952—May 6, 1982.
Patent Abstracts of Japan—56183630—May 27, 1983.

* cited by examiner

*Primary Examiner*—John M. Jillions
(74) *Attorney, Agent, or Firm*—Schiff Hardin & Waite

(57) ABSTRACT

A method and device for output of single sheets from a printer employs a driven first roller pair having a conveying nip in which a respective single sheet is transported and deflected from an approximately vertically proceeding conveying path into an approximately horizontal conveying path. A separation element that suppresses a continued conveying of the respective single sheet on a circumferential surface of a lower roller of the roller pair is arranged in a proximity of the circumferential surface of the lower roller. An edge sensor is arranged preceding the roller as viewed in a conveying direction for determining whether single sheets have pushed on top of one another. A discharge brush electrically discharges one side of the single sheet arranged in the conveying path following the roller pair. A deflection device deflects the single sheet emerging from the conveying nip into a substantially horizontal attitude shortly before the conveying nip as viewed in a direction of the conveying path. The discharge brush is mounted to the end of the deflection device.

10 Claims, 1 Drawing Sheet

DEVICE FOR OUTPUTTING SINGLE SHEETS FROM A PRINTER

BACKGROUND OF THE INVENTION

The invention is directed to a device for outputting single sheets from a printer or a copier, comprising a driven roller pair in whose conveying nip the respective single sheet is transported and which is deflected from an approximately vertically proceeding conveying path into an approximately horizontal conveying path, and comprising a deposit compartment for the deposit of the conveyed single sheets.

Such a device is utilized, for example, in high-performance printers, whereby the deposit compartment is a specimen compartment in which, for example, individual sheet specimens of a test printing are deposited. Traditional apparatus have shown that their operating dependability is limited and a paper jam in the output region occurs disproportionately often.

JP-A-57 072561 discloses a device for outputting single sheets from a printer or copier. The single sheets are conveyed forward by a roller pair. A rejector unit that suppresses a further-conveying of the respective single sheet on the circumferential surface of this roller is arranged at the roller.

U.S. Pat. No. 4,511,238 discloses a device in an electrophotographically working copier. This device successively supplies single sheets to further units. A sensor, for example a mechanical sensor, acquires the presence of a single sheet between conveyor rollers.

U.S. Pat. No. 4,570,801 discloses a device for conveying single sheets. An optoelectronic sensor checks the conveyed single sheets. When a jam occurs, for example due to single sheets sliding on top of one another, this jam is reported to a higher-ranking control.

JP-A-58 089557 discloses a paper output unit of a copier machine where single sheets are conducted between rollers. Each single sheet passes a guide that assures that the single sheet is supplied to a deposit compartment.

SUMMARY OF THE INVENTION

An object of the invention is to specify a device for the output of single sheets that works operationally dependably and avoids a paper jam.

This object is achieved by the initially cited device in that a rejection unit is arranged in the proximity of the circumferential surface of the lower roller of the roller pair, this rejection unit suppressing a continued conveying of the respective single sheet on the circumferential surface of the lower roller.

The invention is based on a perception that it is precisely the lower roller of the roller pair that is critical, since single sheets are still held at the generated surface due to electrostatic forces or the force of gravity in the transition between vertical conveying and horizontal conveying, and can be drawn into the structural necessary gap between lower roller and deposit compartment, whereby they can cause a paper jam. According to the invention a rejection or separating element is arranged in the proximity of the circumferential surface of the lower roller. This rejection or separating element lifts the respective single sheet off from the generated surface of the lower roller, and adhesion of the single sheet is no longer possible. The single sheet is compelled to pass through the discharge gap between roller pair and deposit compartment. The present invention thus works operationally dependably and reliably.

The generated surface of the lower roller preferably has at least one channel-shaped recess into which the rejection or separating element engages. When this rejection unit is designed as a flashing, it has front, finger-like sections engaging into the recess or into a plurality of recesses on the generated surface of the lower roller. As a result of this arrangement, the single sheet is reliably lifted off from the generated surface of the lower roller, as a result whereof a wrapping of the lower roller is made impossible.

According to the invention, a discharge brush which preferably electrically discharges that side of the single sheet lying up is arranged in the conveying path following the roller pair. The discharge brush is thus arranged at a position such that the single sheet is no longer in frictional contact with conveyor elements. The electrostatic discharge of the sheet can thus no longer be reversed by such conveyor elements. The single sheets deposited in the deposit compartment thus do not adhere due to electrostatic effects and can be easily individually separated from one another.

In the invention, an edge sensor with the assistance of which a determination can be made as to whether prescribed intervals are adhered to between single sheets following one another is arranged preceding the roller pair as viewed in a conveying direction. The structure of such an edge sensor is known in and of itself For example, the edge sensor can be designed as a light barrier that indicates the lack of a sheet within the light barrier. When conveyed single sheets slide on top of one another in the conveying path, then the edge sensor can no longer detect a starting edge or, respectively, ending edge of single sheets. Such a condition is then interpreted as a paper jam. The operating dependability of the apparatus is further enhanced by this technique.

DESCRIPTION OF THE PREFERRED EMBODIMENTS

Figure 1:
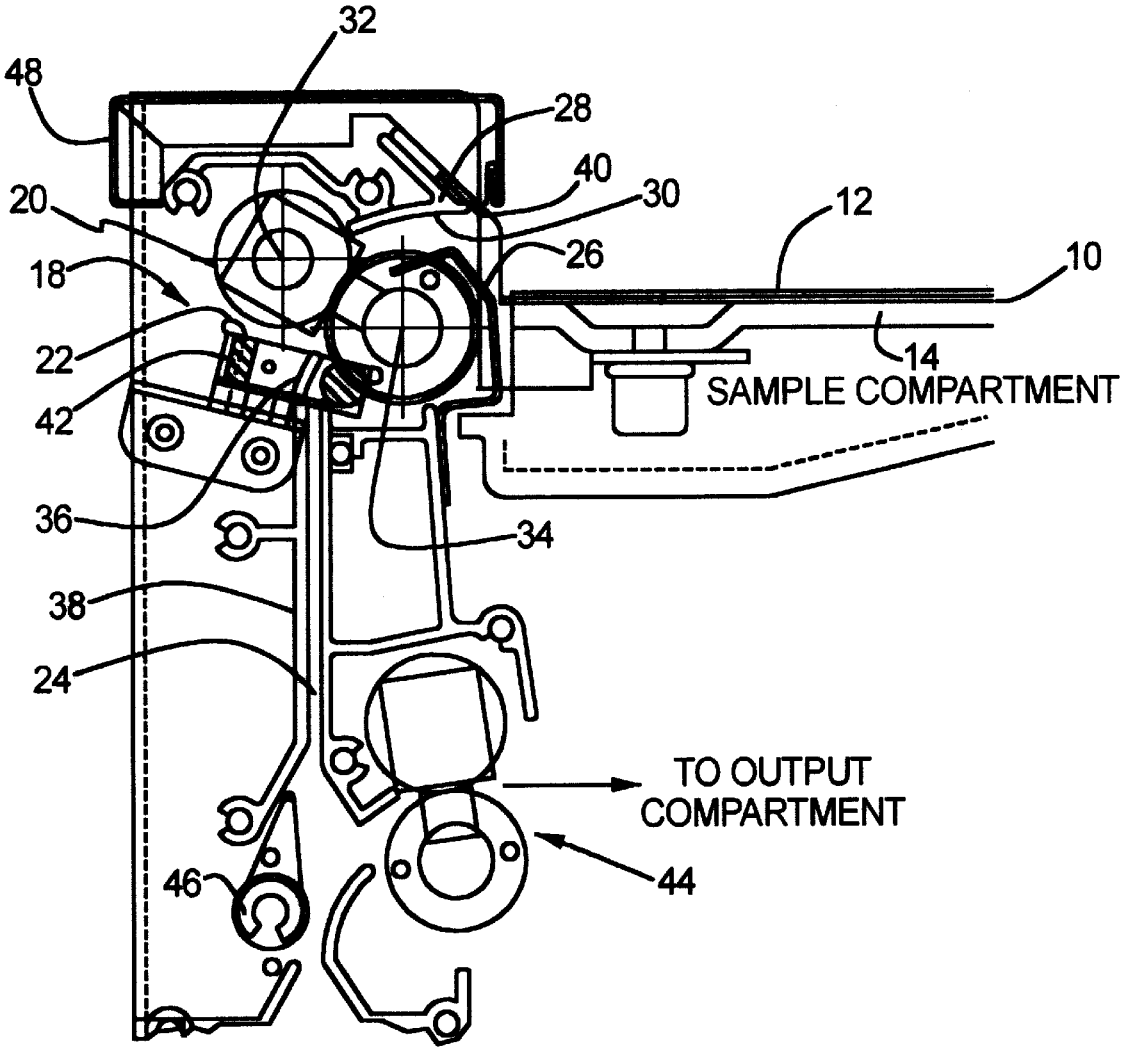
FIG. 1 is a side view of the output-side apparatus according to the invention for a high-performance printer.

An exemplary embodiment of the invention is described below with reference to the single Figure. This Figure shows the output-side apparatus section of a high-performance printer that successively prints single sheets. The single sheets 12 are individually successively deposited in a specimen or sample compartment and can be removed individually or as a packet. A roller pair 18 with an upper roller 20 and a lower roller 22 serves the purpose of forward conveying of the single sheets 12. The single sheets 12 are conveyed up via a vertically proceeding paper channel 24, reach the conveying nip in the roller pair 18, are subsequently diverted into a horizontal attitude and are then deposited in the specimen or sample compartment 14.

The lower roller 22 has annular recesses in the fashion of channels on its generated surface. Fingers of a flashing or baffle 26 as a separation element engage into these channels. When conveying single sheets 12 through the conveying nip, the flashing 26 reliably lifts or separates the respective single sheet 12 from the generated surface of the lower roller 22, so that it cannot remain adhering to the surface of the lower roller 22 due to the force of gravity or due to electrostatic forces.

The single sheets conveyed through the conveying nip are redirected by a deflection element 28, i.e. the conveyed edge of a conveyed single sheet strikes the arced, leading surface 30 inclined in the direction of the horizontal line in the deflection unit designed as a profile, whereby the single sheet 12 is deflected little by little from the vertical paper channel 24 via the conveying nip and the deflection element or device 28 into a horizontal attitude and is then gently output onto the stack of single sheets 12 in the specimen compartment 14.

The attack angle of the surface 30, the angle of the plane proceeding through the rotational axes 32, 34 of the roller pair 18 and the bent-over end 36 of the guide profile arranged in the paper channel 24 are matched to one another such that the respective single sheet 12 is deflected from the vertical into the horizontal upon exertion of slight forces.

At its end remote from the roller pair 18, the deflection element or device 28 carries a discharge brush 40 that frees the upper side of the single sheet 12 from electrostatic charges. Since this upper side of the single sheet 12 subsequently no longer comes into contact with further conveyor elements, a renewed electrostatic charging cannot occur. The single sheets 12 of the stack 10 can thus be also easily withdrawn individually without overcoming electrostatic forces.

A light barrier 42 is arranged preceding the roller pair 18 as viewed in the conveying direction. Whether prescribed intervals are still present between successive single sheets 12 or whether single sheets have slipped on top of one another as a result of a paper jam can be recognized with the assistance of this light barrier. When the latter is true, then a control signal that indicates a paper jam condition and potentially shuts down the printer can be determined from the signal of the light barrier.

A further roller pair 44 is shown in FIG. 1 that supplies single sheets to a further output compartment (not shown). Dependent on the position of the shunt 46, single sheets are supplied either to the roller pair 18 (this condition is shown in the Figure) or to the roller pair 44.

The apparatus of the invention makes it possible to arrange the discharge opening behind the roller pair 18 relatively far toward the top at the upper end of the entire frame 48 of the printer, as a result whereof the stacking capacity of the specimen or sample compartment 14 is enlarged. The combination of baffle or flashing 26, deflection element or device 28 and discharge brush 40 means that a paper jam is avoided and the overall output of single sheets into the specimen compartment 14 occurs reliably. Although various minor changes and modifications might be proposed by those skilled in the art, it will be understood that our wish is to include within the claims of the patent warranted hereon all such changes and modifications as reasonably come within our contribution to the art.

What is claimed is:

1. A device for output of single sheets from a printer or copier, comprising:

a driven roller pair having a conveying nip in which a respective single sheet is transported and is deflected from an approximately vertically proceeding conveying path into an approximately horizontal conveying path;

a deposit compartment for depositing the conveyed single sheets;

a separation element that suppresses a continued conveying of the respective single sheet on a circumferential surface of a lower roller of said roller pair, said separation element being arranged in a proximity of the circumferential surface of the lower roller;

an edge sensor arranged preceding the roller pair as viewed in a conveying direction, said edge sensor determining whether single sheets have pushed on top of one another as a result of a paper jam;

a discharge brush which electrically discharges one side of the single sheet arranged in the conveying path following the roller pair;

a deflection device that deflects the single sheet emeroing from said conveying nip into a substantially horizontal attitude; and said discharge brush being mounted to said deflection device.

2. The device according to claim 1 wherein the lower roller has at least one channel-shaped recess at a generated surface of the lower roller into which the separation element engages.

3. The device according to claim 2 wherein the separation element is designed as a baffle that has front, finger-like sections engaging into one or more of said channel-shaped recesses on said generated surface of the lower roller.

4. The device according to claim 1 wherein the deflection device is designed as a deflection profile which accepts said discharge brush at an end remote from the roller pair.

5. The device according to claim 1 wherein a plane proceeding through rotational axes of the roller pair describes an angle of 30–60° with vertical.

6. The device according to claim 1 wherein the separation element is arranged between the lower roller and the deposit compartment such that a single sheet is lifted off from a generated surface of the lower roller and is conducted to said deposit compartment.

7. The device according to claim 1 wherein the deposit compartment is an externally freely accessible output compartment of a high performance printer having a plurality of output compartments.

8. A device for output of single sheets from a printer or copier, comprising:

a driven roller pair having a conveying nip in which a respective single sheet is transported and is deflected from an approximately vertically proceeding conveying path into an approximately horizontal conveying path;

a deposit compartment for receiving the single sheets conveyed from said nip;

a separation element that separates the respective single sheet from a circumferential surface of a lower roller of said roller pair;

an edge sensor arranged preceding the roller pair as viewed in a conveying direction, said edge sensor determining whether single sheets have pushed on top of one another as a result of a paper jam;

a discharge brush which electrically discharges one side of the single sheet and which is arranged in the conveying path following the roller pair;

a deflection device having a deflection surface that deflects the single sheet emerging from said conveying nip into a substantially horizontal attitude; and said discharge brush being positioned at the deflection surface.

9. A method for output of single sheets from a printer or copier, comprising the steps of:

providing, a driven roller pair having, a conveying nip in which a respective single sheet is transported to a deposit compartment for depositing of the conveyed single sheets;

conveying the single sheets from the printer or copier vertically upwardly towards the roller pair nip;

prior to entry of the single sheets into the roller pair nip utilizing an edge sensor to determine whether single sheets have pushed on top of one another;

providing a separation element for separating the respective single sheet from a circumferential surface of a lower roller of the roller pair;

engaging a leading end of the sheets in the roller pair nip and then outputting the sheets so that they strike a deflection element as they are separated away from the lower roller by the separation element, the deflection element having a deflection surface deflecting the sheets downwardly, and conveying the sheets into contact with and past a discharge brush positioned at the deflection surface to electrically discharge one side of the single sheet; and depositing the sheets in the deposit compartment.

10. The method according to claim 9 including the step of lifting the sheets with the separation element by having fingers of the separation element engage underneath the sheets where fingers of the separation element engage in grooves of the lower roller.

* * * * *